United States Patent [19]

Thomas

[11] 4,057,014

[45] Nov. 8, 1977

[54] TAPE PRINTER AND STRIPPER ASSEMBLY

[76] Inventor: Charles S. Thomas, 1031 N. Brandon Ave., Marion, Ind. 46952

[21] Appl. No.: 674,858

[22] Filed: Apr. 8, 1976

[51] Int. Cl.[2] ..... B41F 13/02

[52] U.S. Cl. ..... 101/228; 101/181

[58] Field of Search ..... 101/228, 219, 181, 247, 101/235

[56] References Cited

U.S. PATENT DOCUMENTS

| | | | |
|---|---|---|---|
| 2,663,256 | 12/1953 | Chambon | 101/228 |
| 2,741,983 | 4/1956 | Brownell | 101/228 |
| 2,988,990 | 6/1961 | Worth | 101/219 |
| 3,063,369 | 11/1962 | Timson | 101/247 |
| 3,092,019 | 6/1963 | Buskirk | 101/235 X |
| 3,329,087 | 7/1967 | Sandor et al. | 101/181 |
| 3,418,932 | 12/1968 | Macchione et al. | 101/228 |
| 3,487,776 | 1/1970 | Marozzi | 101/219 |
| 3,970,000 | 7/1976 | Rowley | 101/235 |

FOREIGN PATENT DOCUMENTS

| | | | |
|---|---|---|---|
| 1,093,723 | 12/1967 | United Kingdom | 101/228 |

*Primary Examiner*—J. Reed Fisher

*Attorney, Agent, or Firm*—Woodard, Weikart, Emhardt & Naughton

[57] ABSTRACT

Disclosed is an assembly for printing a series of impression sub-series on a continuous web such as paper tape, the printed impression being provided by a plurality of complete rotations of a plate-carrying cylinder which is halted for a timed interval after said printing rotations, the tape continuing to move past the halted plate cylinder at a void on the cylinder between the printing plates; the spacing between impression series being defined by said halted time interval. Also disclosed is a feeder apparatus for delivering overlapped objects such as pad strips one-by-one to a conventional stripper apparatus in synchronization with the printing and delivery of the web by the printing assembly.

4 Claims, 8 Drawing Figures

TAPE PRINTER AND STRIPPER ASSEMBLY

BACKGROUND OF THE INVENTION

In the offset printing of repeated, spaced impressions on a continuous web, such as paper tape used in heading of objects such as paper legal pads or the like, difficulty is encountered in properly spacing the impressions where more than one printing plate is carried on the circumference of the printing plate cylinder. Proper joining of the printed tape to the heading area of the pad in the conventional "stripper" apparatus, so that the printed material is properly oriented on the completed pad, can be accomplished only if accurate spacing of the printed impressions is maintained.

One prior art attempt to overcome the difficulty is disclosed in Crissy U.S. Pat. No. 3,610,147. In the disclosure of the patent the sheet or web to be printed is fed intermittently to a continuously rotating printing cylinder. By utilizing, in contrast, a continuously fed web and an intermittently, rather than continuously, rotated printing plate cylinder, the concept of the present invention provides several distinct advantages. One advantage is that a smaller (in diameter) printing plate cylinder may be utilized. This permits use of smaller printing plates for a given rate of printed tape output resulting in substantial cost saving of the order of 50 percent. Relatively small diameter plate cylinder and correspondingly small printing plates may be used and the required relatively long spacing between series or groups of printed impressions may still be obtained. The printer, utilizing the concept of the present invention, can be placed in-line with respect to the stripper apparatus where the tape and the pads are joined and such an arrangement has hitherto been unknown in the prior art. Two or more printers embodying the present invention may be placed in-line with the stripping apparatus to allow printing in more than one color or to facilitate rapid change-over of print color. Intermittently rotating the printing plate cylinder while continuously moving the web or tape permits printing with a printing cylinder having a circumference smaller than the length of the series or group of printed impressions while still leaving substantial space on the web between each series of printed impressions on the web. Since the plates are not damaged by movement of the tape across them (movement of the tape with relation to the stationary plate cylinder occurs only in a void area between printing plates on the cylinder), the printing plates have an extended useful life, of the order of three hundred thousand impressions, far longer than is the case when the plates are conventionally utilized. The apparatus of the present invention further provides a means for separating the moving tape or web and the printing plates on the plate cylinder whenever a malfunction occurs.

The concept of the present invention further envisages providing a feeding apparatus for feeding pad strips (uncut groups of pads) to the stripper apparatus where the printed tape is applied as a cover-binding to one marginal area of the strips. The feeding apparatus is characterized by two separate, but overlapping endless belt conveyors which are coordinated so that pad strips are fed one-by-one into the stripper apparatus where the printed tape is applied. The arrangement is such that the pad strips may be placed by the operator on the conveyor means in overlapping relation to each other, the effective area under control of the operator thus may accommodate a larger number of objects (pad strips) than would be the case if the objects had to be lined up in prior art, non-overlapping alignment.

DESCRIPTION OF THE PREFERRED EMBODIMENT

Figure 1:
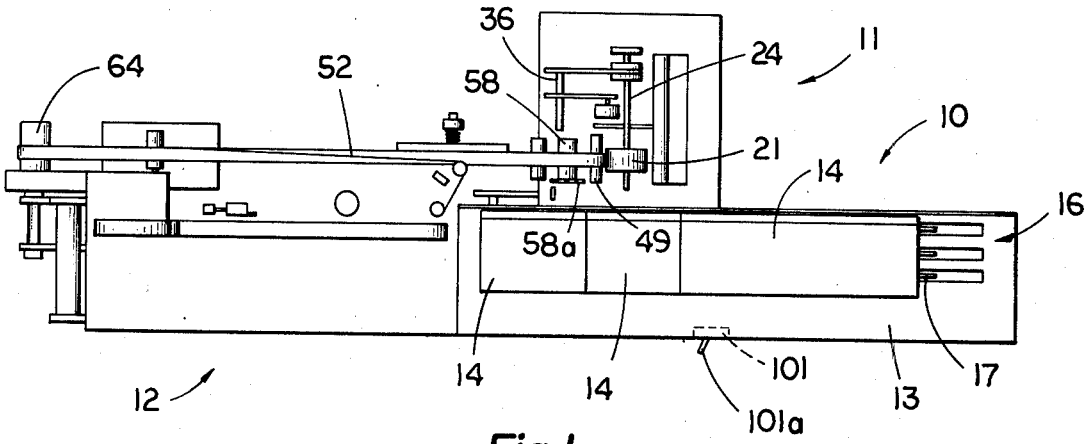
FIG. 1 is a top plan view of the printing and feeding apparatus of the present invention coupled with a conventional stripper apparatus.

Referring initially to FIG. 1, the overlapping feed section or component of the apparatus is generally indicated at 10 and the printer section is illustrated generally at 11. The components 10 and 11 are mounted on independent frames which may be suitably secured together and may be provided with adjustable legs for leveling. A conventional stripper apparatus is shown generally at 12, this apparatus being conventional in the prior art and functioning to properly join the printed tape with the margins of the stripper pads. A table 13 permits the operator to stack, in overlapping relation to each other, a group of pad strips 14, three being shown in FIG. 1. The table is slotted as indicated at 16 and accommodated within the slots are a plurality of abutments or dogs 17 which are moved within the slots by means of a flexible conveyor member 18 (FIG. 8) as will subsequently be explained.

Figure 4:
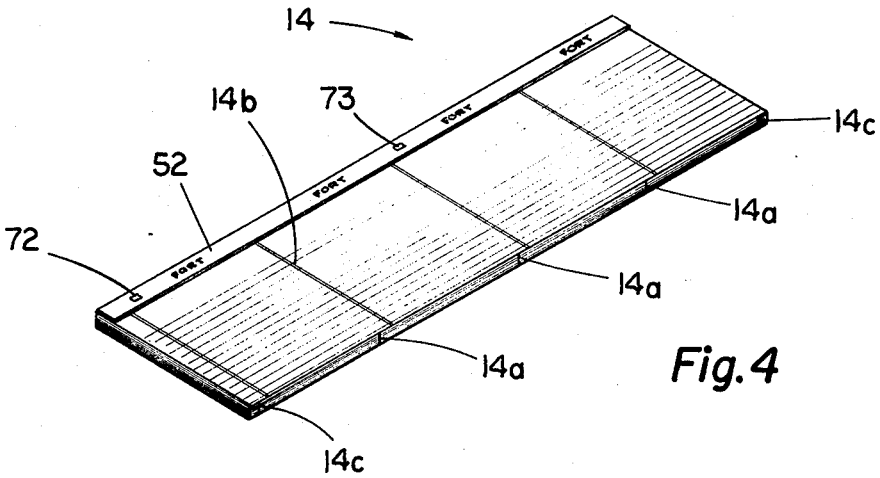
FIG. 4 is a perspective view of an uncut pad strip.
Figure 6:
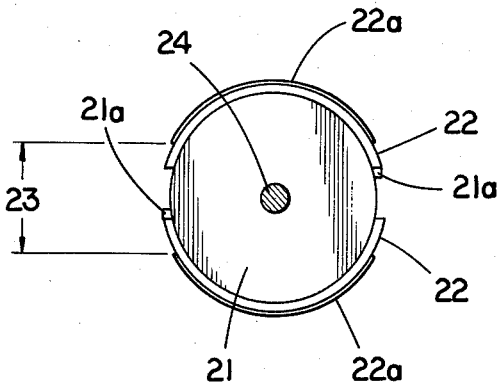
FIG. 6 is an end view of the printing plate cylinder component of the apparatus of FIG. 2 illustrating two printing plates in place on the printing cylinder and illustrating the void or gap between the plates.

One of the tab strips 14 is shown in detail in FIG. 4 (the pad shown in FIG. 4, however, has the binding strip applied to it) and may be seen to include an elongated paper pad which is to be subsequently cut along the lines **14*a* into four separate pads having vertical margin lines 14*b*. The marking lines 14*c* mark the end areas which may be trimmed off in final trimming of the pads. The printing of the heading tape shown applied to the pad strip 14 of FIG. 4 will now be described with reference to FIG. 2. Reference numeral 21 identifies a printing plate cylinder carrying two diametrically opposite printing plates 22 which may be suitably formed of a magnetic, elastomeric material. The printing plates and their arrangement on the plate cylinder 21 is shown in detail in FIG. 6. Each of the printing plates 22 may be seen to have a raised printing area 22*a* in FIG. 6 and each printing plate is anchored against radially extending abutments 21*a*. The gap or void 23 between the ends of the raised printing areas of the plates is illustrated by the dimension line 23 in FIG. 6. Returning to FIG. 2, the plate cylinder 21 is rigidly secured to and rotates with a control shaft 24 which carries a gear 26 and a sheave 27. A drive motor 33** drives speed change gearing 32 which by means of a belt 31 drives a conventional clutch-brake unit 29 which is controlled by a timer 30 and functions to drive the belt 28 in intermittent fashion with a minimum of overrun. The belt 28 functions to drive the sheave 27. A gear 34, having twice the number of teeth of the gear 26, meshes with the gear 26 and rotates a shaft 36. A radially outward extending abutment 37 rotated by the shaft 36 functions to actuate the operating arm of the switch 38 which controls the timer 30 as will subsequently be explained. A further radially extending abutment 39 rotated by the shaft 36 functions to actuate the operating arm of the switch 41 whose function will be subsequently explained and a 180° cam 42 is rotated by the shaft 36 and functions to actuate the operating arm of the switch 43 for 180° of each revolution of the shaft 36, this action having a function which will subsequently be explained.

Figure 2:
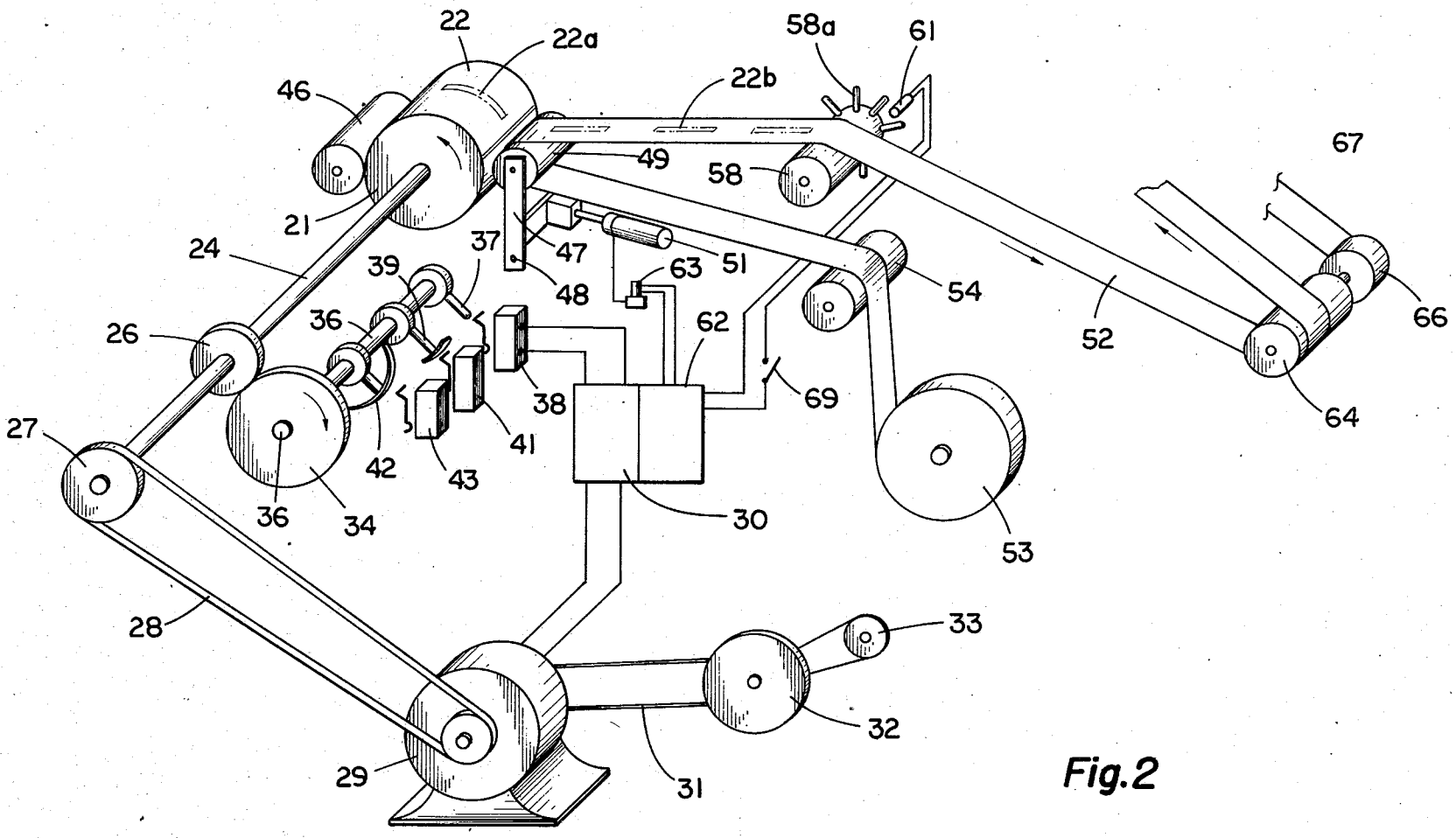
FIG. 2 is a schematic, perspective view of the components of the printing assembly.
Figure 5:
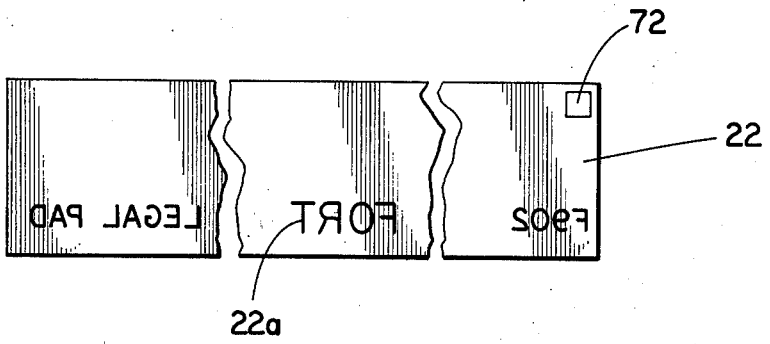
FIG. 5 is a top plan view of a flexible printing plate prior to its installation on a printing plate cylinder.

It may be seen in FIG. 2, a conventional ink transfer roller is shown schematically at 46 and functions, as is conventional, to transfer ink from a well (not shown) to the raised printing surfaces 22*a* of the printing plate 22. Mounted in a frame 47, pivoted at 48 is an impression roller 49. A motor element which may take the form of a pneumatic cylinder 51 has its thrust rod connected to the frame 47 and functions to move the impression roller 29 into and out of the position in which the continuous web or tape 52, passing over the roller 49 receives a printed impression from the raised portion 22*a* of the printing plates 22. A web of tape to be printed is indicated at 53, the tape passing over idler roller 54 and subsequently over the impression roller 49. When the impression roller 49 is in position against the plate cylinder 21, upon rotation of the plate cylinder, the tape will receive a series of printed impressions 22*b* two impressions being put down for each complete revolution of the printing cylinder 21. The tape next passes over a tape speed sensing roller 58 which is free turning and adjacent one of its ends is provided with radially extending arms 58*a* which function to receive and reflect back a light beam (issuing parallel to the axis of rotation of the roller 58) from the conventional light and detecting head 61. The head 61 is connected by suitable electrical wiring to a conventional timer device 62 which functions to energize the solenoid valve 63 if the light sensing head 61 does not receive an indication that the tape is moving at the proper speed. The solenoid valve functions to provide pressurized air to the cylinder 51 so that, should the movement of the tape fall below a predetermined speed indicating a malfunction, the actuator 51 will function to withdraw the impression roller away from the plate cylinder 21.

Figure 3:
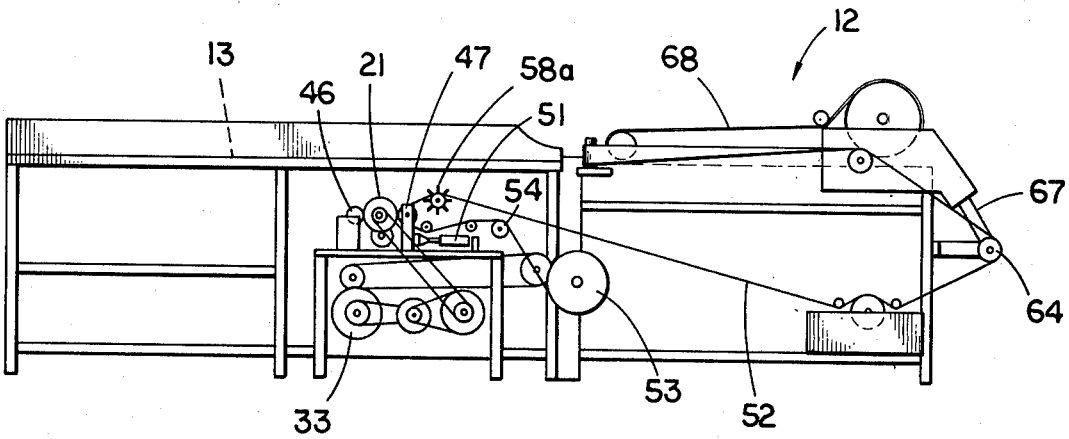
FIG. 3 is a side view of the apparatus shown in FIG. 1, the view being taken from that side of the composite apparatus shown at the top of FIG. 1.

As may be seen in FIG. 2 the imprinted web or tape 52 next passes over the tape speed control roller 64. The roller 64 is driven from a conventional torque control device 66 which permits the tape to be hand pulled over the roller 64 when there is no drive to the torque control 66 as when webbing the machine. Normally, when the stripper apparatus is in operation the timing belt 67 is driven from a drive means for the stripper apparatus transport belt 68, the stripper apparatus transport belt being shown fragmentarily in FIG. 3. The arrangement is such that the drive provided through the belt 67 to the tape speed control roller 64 maintains the surface speed of the roller 64 at the same speed as the surface speed of the stripper apparatus transport belt 68 (FIG. 3). This allows the tape to be hand pulled at a speed equal to the speed of the stripper apparatus transport belts upon initial start-up. It will be understood that the torque control 66 could be omitted and could be replaced by a clutch which is released when manual pulling of the tape is to be accomplished while the machine is stopped. The clutch could be controlled manually, or alternatively, might take the form of a conventional, electrically controlled clutch, the controlling signal being supplied by a conventional photo electric device similar to control device 102 (FIG. 8) mounted on the stripping apparatus. Such a clutch and control would be arranged to lock up (eliminating its torque limiting function) whenever the apparatus is in operation and no pad strips are present in the stripping apparatus. The clutch, when locked, would permit the tape to be hand pulled only at a speed equal to the speed of the stripper apparatus transport belts upon initial start-up. When pad strips are present on the stripper transport belts, the photo sensing device would electrically restore the torque limiting function of the clutch. As will be evident in FIG. 3, prior to the tape moving over the speed control roller 64 it may be passed across a conventional glue box roller so that adhesive may be applied to one surface of the tape prior to its moving over the roller 64. A switch 69 in the circuit to the timer 62 is opened when the drive motor 33 is deenergized so that the speed sensing roller 58 does not give an indication of the tape movement to the actuator 51 while the tape is being hand pulled past the roller 58 upon webbing of the machine. The impression roller 49 is thus retracted away from the plate cylinder when the motor is deenergized.

During operation of the printing apparatus, shown in FIG. 2, the printing cylinder 21 is rotated through two complete revolutions and is then halted with the impression roller 49, and hence the area of contact of the tape with the cylinder 21, occuring at a void or gap (identified at 23 in FIG. 6) between the raised portions of the two diametrically opposite printing plates. During the periods in which the printing cylinder 21 is halted, the tape 52 continues to be drawn over the roller 49 by the operation of the stripper apparatus 12 (FIG. 1). This is accomplished by the relative size of the gears 26 and 34 being such that the shaft 36 rotates at one-half the speed of rotation of the printing cylinder shaft 24. After printing cylinder 21 has moved through two complete revolutions, imprinting four impressions 22*b* on the tape, the abutment 37 will actuate switch 38 which, in turn, actuates the timer 30 to release the clutch and engage the brake of clutch-brake unit 29. After a timed period of, for example, 0.15 seconds the timer will again engage the clutch and release the brake of unit 29 restarting rotation of the plate cylinder 21. During the time in which the cylinder 21 is halted, approximately 2½ inches of tape will pass the void area of the plate cylinder 21. At the end of the predetermined time the timer 30 will again initiate a two revolution rotation of the plate cylinder 21 and a series of four printing impressions will again be put down on the tape 52.

It will be understood that should a printing plate cylinder 21 of differing size be utilized, the drive output sheave on the unit 29 may also be replaced to alter the speed of rotation of the shaft 24 so that the surface speed of the printing plate cylinder of reduced size would still have the same surface speed as that of the transport belt 68 in the stripping machine, this surface speed being imparted to the tape by the roller 64. The speed change gearing 32 might also be altered to provide a fine setting for the speed of the shaft 24 and plate cylinder 21 to allow for, for example, the stretch characteristic of certain of the tapes undergoing the printing operation. Since the relative movement between the tape and the halted printing plate cylinder 21 always occurs at a void between raised portions of the printing plates, the printing plates or pads are not worn by movement of the tape and it is not necessary, therefore, to retract the impression roller 49 away from the printing cylinder 21 each time the printing cylinder is halted.

The conventional stripper apparatus is provided with an eye spot detector or color scanner 71 (FIG. 8) and this scanner senses the presence of a leading eye spot 72 (FIG. 4) printed on the tape by one of the printing plates 22*a*. As will be evident from FIG. 4, two eye spots thus appear on each tape strip, the leading one being necessary for actuation of the scanner 71 which properly coordinates the tape with the incoming pad strip, the trailing eye spot, indicated at 73 in FIG. 4 is superfluous and the function of the cam 42 and switch 43 is to cyclically disable the scanner 71 from reporting the presence of this superfluous eye spot 73. The switch 41 and cam 39 of FIG. 2 provide coordination with the feeding apparatus of FIG. 8 as will subsequently be described.

Figure 7:
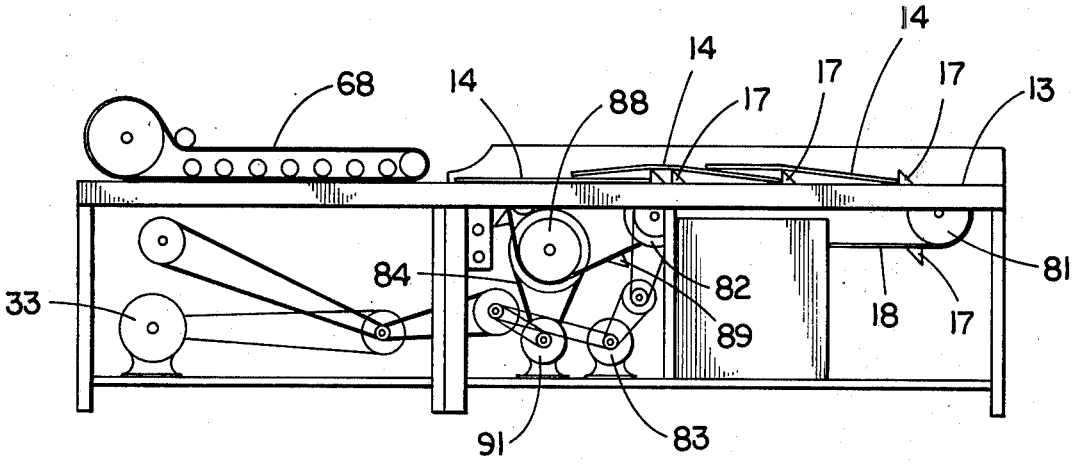
FIG. 7 is a side view of the composite apparatus shown in FIG. 1 taken generally from the side of the apparatus appearing at the base of FIG. 1.
Figure 8:
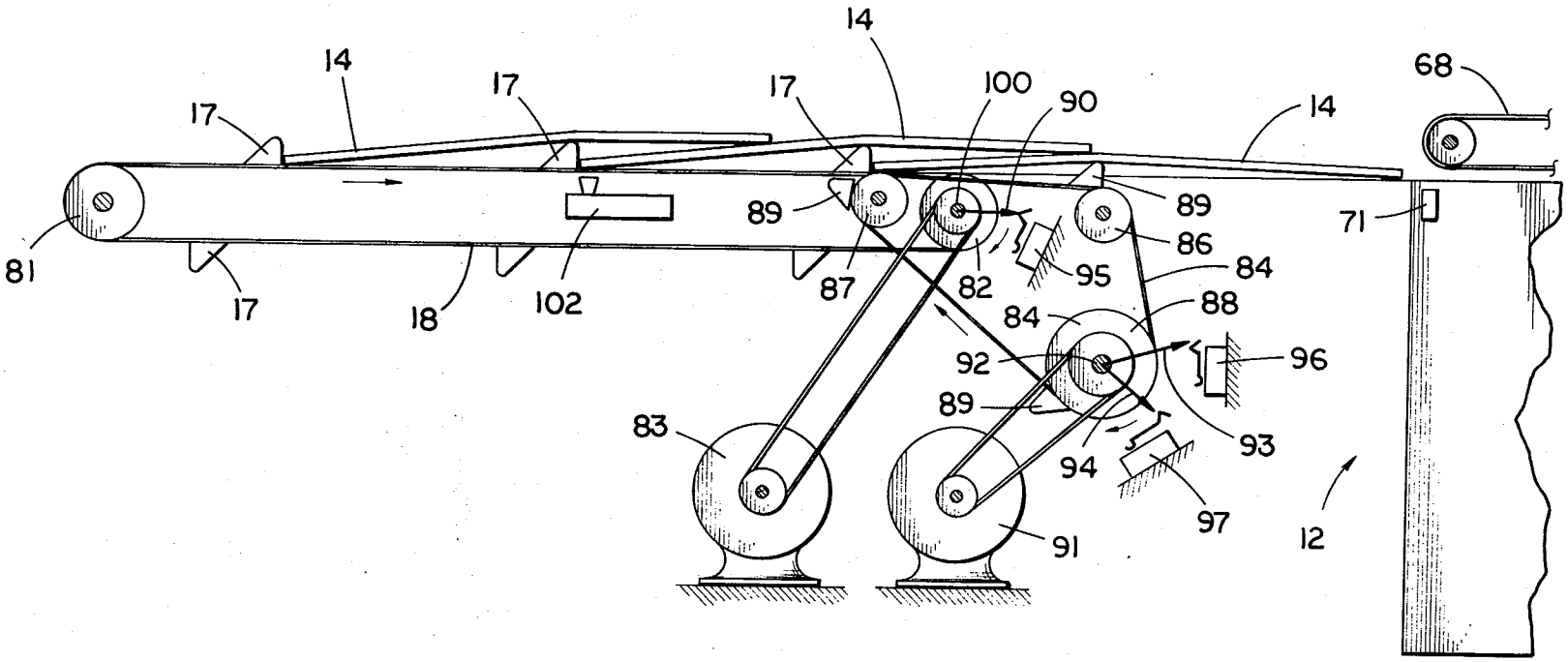
FIG. 8 is an enlarged, fragmentary, schematic view of the overlap feed assembly forming a component of the present invention.

Referring to FIGS. 7 and 8, the overlapping feed apparatus will now be described. The assembly includes the table 13 (FIGS. 1 and 7) which is slotted as shown in FIG. 1 to receive the upwardly extending abutments or dogs 17. The dogs 17 are carried, as previously mentioned, by the endless flexible member 18 which, as will be evident from FIG. 8, is moved between an idler wheel 81 and a driving wheel 82. The drive wheel 82 receives its driving impetus from a conventional clutch-brake unit 83 which, as will be evident from FIG. 7, receives its impetus through a combination of belts and sheaves from the drive motor 33. The shaft 100 which rotates with wheel 82 has extending from it a cam or actuating member schematically shown at 90 which functions to actuate the operating arm of switch 95. The space between the dogs 17 is substantially less than the width dimension of the pad strip 14 as will be evident from FIG. 8 so that the trailing portion of the leading pad strip 14 underlies the leading portion of the next following pad strip.

A second endless conveyor member 84 (FIG. 8) having a generally horizontal pass parallel to and overlapping the terminal portion of the upper pass of the conveyor member 18 moves over idlers 86 and 87 and over the drive wheel 88. Extending outwardly from the conveyor member 84 are abutments or dogs 89. The drive wheel 88 receives its rotational impetus from the conventional brake-clutch unit 91 which, as will be evident from FIG. 7, is driven through various belts and sheaves by the drive motor 33.

The shaft 92 which rotates with the driving wheel 88 has extending from it two cam or actuating members schematically shown at 93 and 94 which function to actuate the operating arm of the switches 96 and 97 respectively.

As previously mentioned, the printed eye spot detector 71 (FIG. 8) properly orients the tape and the entering pad strip 14 as it is received by the stripping apparatus conveyor belt 68 and operates when a switch 101 (FIG. 1), having a manual operator arm 101*a* is thrown to "automatic" or "print" position to engage the clutch and release the brake on the clutch-brake unit 91 thus causing the conveyor 84 and the abutments 89 to begin their motion.

Again referring to FIG. 8, there is indicated at 102 a photoelectric control of the type which includes a light source and a receptor, the apparatus, which is conventional, functioning to direct a light beam at a reflector overhead (not shown), its receptor receiving the reflected beam. As long as the beam is not reflected there is no effect on the speed of operation of the drive motor 33. However, in the presence of the reflected beam, indicating that no pad strip 14 occupies the space immediately above the control 102, the control will function to lower the speed of the drive motor 33 for a predetermined time interval. This gives the operator, who is depositing the pad strips in proper position with relation to the abutment 17, time to catch up with the operation of the device, thereby obviating stopping and restarting the printing stripping operation each time the operator falls slightly behind the operation of the machine.

In the operation of the feeding apparatus shown in FIG. 8, with the conveyor element 84 being moved by the drive through the clutch-brake unit 91, the cam 34 on the shaft 92 will actuate the switch 96 to engage the clutch and release the brake on the clutch-brake unit 83, starting motion of the conveyor element 18 and of the abutment 17. The abutment 17 engages the leading pad strip 14 and places the pad strip in motion before the adjacent abutment 89 on the conveyor element 84 moves into engagement with the trailing edge of the leading pad strip to move it into the stripper apparatus 12, the abutment 17 on the conveyor 18 leaving the pad strip edge shortly after it is engaged by the abutment 89 on the conveyor 84. The abutment 89 thus meets the pad strip while it is in motion as a result of the impetus provided to it by the abutment 17. As this motion occurs at the leading pad strip, the subsequent abutments 17 continue to move the pad strips into position, the operator placing an additional pad strip in the space available as the preceeding strip moves ahead. After each advance of the conveyor member 38 (that is, one complete revolution of the drive wheel 82) the cam 90, which rotates with the wheel 82, actuates with the operating arm of the switch 95 which functions to engage the brake and release the clutch of the clutch-brake unit 83, thereby halting momentarily the motion of the conveyor member 18. Similarly, at the end of each complete revolution of the drive wheel 88 the cam 94 actuates the switch operating arm of the switch 97 which functions through the clutch-brake unit 91 to halt the movement of the conveyor member 84 and the abutments 89 carried by it. The reading of the next eye spot by the detector 71 again restarts the cycle and the conveyor members 84 and 18 advance in step-by-step fashion inserting the overlapping pad strips one-by-one into the stripping apparatus 12.

To start up or initiate automatic operation of the printer and feeder assemblies with the stripper apparatus, the operator first webs the printer with tape from roll 53 (FIG. 2) and places pad strips 14 on the feeder assembly as shown in FIG. 8. Drive motor 33 is then energized starting rotation of plate cylinder 21 and the operator pulls the tape, at a low tension level, over the roller 64 until the glue-laden tape arrives at the marriage point of the pad strips 14 and the printed tape. The switch 101 (FIG. 1) by means of its operating arm 101*a* is then placed in "plain" or start-up position and this, by suitable circuitry, permits switch 41 (FIG. 2), when actuated by member 39, to start the motion of conveyor 84 and abutments 89. When switch 101 is in "plain" position, actuation of switch 41 bypasses, in effect, the scanner control 71 (FIG. 8) permitting the leading pad strip 14 to be advanced into the stripping apparatus 12 without a signal from scanner control 71. The conveyor member then feeds the leading pad strip into the conveyor 68 on the stripping apparatus. The initial pad strip width of tape is then joined to the leading pad strip 14 and the operator moves switch 101 (FIG. 1) to print position, removing control of conveyor member 84 from switch 41 (FIG. 1) and placing its starting under control of scanner control 71. Operation of the combined apparatus then proceeds as previously described. It should be noted that only the initial pad strip 14, the one moved to the stripping apparatus while scanner control 71 was by-passed by switch 41 carries a printed tape heading in which the printing is not properly oriented or placed with respect to the pad strip. Only the initial pad strip, therefore, need be discarded on start-up, the following pad strips moving through the apparatus 12 being properly oriented with the printed tape by means of scanner control 71.

The apparatus described functions to print, without halting, the required number of headings or impressions on each portion of tape to be applied to a single pad strip. The printing cylinder then halts, or dwells, while the tape length providing the desired spacing between series of headings (between pad strips) is drawn past the printing cylinder, subsequently, the printing cylinder restarts. The primary advantage of this mode of operation is that for a given volume of printing, fewer printing plates are required thereby saving in the cost of relatively expensive, elastomeric printing plates or blankets. Where the printing volume is high, this cost saving is multiplied. As previously mentioned, the printing-stripping operation may be initiated with the loss of only the initial pad strip due to unprinted or improperly located printing. With respect to the feeding apparatus, the arrangement allows the relatively large pad strips to be overlapped thereby increasing operator efficiency by decreasing the reach required to place pad strips in the stripping apparatus. The feed apparatus reduces the speed of the drive for the printing and feeding components if the operator fails to maintain a predetermined number of pad strips on the feeding conveyor thereby reducing or eliminating shut-downs of the stripping apparatus due to feeding problems.

While the invention has been disclosed and described in some detail in the drawings and foregoing description, they are to be considered as illustrative and not restrictive in character, as other modifications within the scope of the invention may readily suggest themselves to persons skilled in the art.

I claim:

1. An assembly for placing series of imprints on a continuous web of material by passing it between a rotating printing plate cylinder and an impression cylinder, with the space between each series of imprints on the strip differing from the space between each imprint within a series, said assembly comprising said plate cylinder carrying a plurality of printing plates in spaced relation around its circumference, drive means for rotating said plate cylinder at uniform speed, control means for halting said plate cylinder for a predetermined time period each time said plate cylinder has moved through a predetermined number of complete revolutions and said impression cylinder is opposite a void between the spaced printing plates, said control means including a control shaft driven by said plate cylinder drive means at a rotational speed which is the $1/n$ fraction of the rotational speed of said plate cylinder where $n$ is the number of printing plates carried on the circumference of said plate cylinder, an element carried by said control shaft adapted to provide an electrical signal upon each complete revolution of the control shaft, and timing means actuated by said electrical signal for halting said drive means for a predetermined time upon occurrence of said electrical signal, and means for continuously pulling the web between the plate cylinder and the impression cylinder at a speed equal to the surface speed of the rotating printing plate cylinder, whereby with the plate cylinder halted the web moves relative to the plate cylinder only when said impression roller registers with a void between said spaced printing plates, the time interval in which said relative movement occurs defining the length of the space between series of imprints, and the number of imprints in each series being the product of the number of complete revolutions of said plate cylinder between said halted intervals and the number of spaced printing plates carried on said plate cylinder.

2. An assembly as claimed in claim 1 in which a web speed sensing means is disposed adjacent the web downstream of said plate and impression cylinder, a moveable support member for said impression cylinder, a motor element cooperating with said moveable support member for withdrawing said impression cylinder away from said plate cylinder when said motor element is actuated, said speed sensing means actuating said motor element whenever the speed of said web falls below a predetermined value.

3. An assembly as claimed in claim 2 having, in addition, a web speed control roller around which the web passes, said roller being disposed downstream of said speed sensing means, and drive means for said roller providing a surface speed therefor substantially equal to the surface speed of said plate cylinder.

4. An assembly as claimed in claim 1 in which a web speed sensing means is disposed adjacent the web downstream of said plate and impression cylinder, a moveable support member for said impression cylinder, a motor element cooperating with said moveable support member for withdrawing said impression cylinder away from said plate cylinder when said motor element is actuated, said speed sensing means actuating said motor element whenever the speed of said web falls below a predetermined value, said web speed sensing means comprising a free running roller engaged by the web and rotated thereby, means providing a light beam directed substantially parallel to the rotation axis of said roller and for sensing interruption of said beam, and radially extending arms on said roller for sequentially interrupting said light beam at a frequency which is a direct function of the speed of rotation of said roller.

* * * * *